US008465266B2

(12) United States Patent
Gieras et al.

(10) Patent No.: US 8,465,266 B2
(45) Date of Patent: Jun. 18, 2013

(54) VACUUM PRESSURE SYSTEMS

(75) Inventors: Jacek F. Gieras, Glastonbury, CT (US); Thomas G. Tillman, West Hartford, CT (US); Hayden M. Reeve, Hartford, CT (US)

(73) Assignee: United Technologies Corp., Hartford, CT (US)

( * ) Notice: Subject to any disclaimer, the term of this patent is extended or adjusted under 35 U.S.C. 154(b) by 1027 days.

(21) Appl. No.: 11/871,428

(22) Filed: Oct. 12, 2007

(65) Prior Publication Data

US 2009/0096230 A1 Apr. 16, 2009

(51) Int. Cl.
*F04B 17/04* (2006.01)
*F04B 35/04* (2006.01)

(52) U.S. Cl.
USPC ..... 417/417; 417/416

(58) Field of Classification Search
USPC ..... 417/416, 417, 418; 96/7; 123/516
See application file for complete search history.

(56) References Cited

U.S. PATENT DOCUMENTS

| | | | | |
|---|---|---|---|---|
| 3,572,980 | A * | 3/1971 | Hollyday | 417/413.1 |
| 5,201,641 | A * | 4/1993 | Richer | 417/417 |
| 5,806,300 | A | 9/1998 | Veilleux, Jr. et al. | |
| 6,514,047 | B2 * | 2/2003 | Burr et al. | 417/53 |
| 6,526,951 | B2 | 3/2003 | Ishigaki et al. | |
| 6,543,232 | B1 | 4/2003 | Anderson et al. | |
| 6,581,904 | B2 | 6/2003 | Watanabe et al. | |
| 6,732,718 | B2 | 5/2004 | Kano et al. | |
| 6,736,614 | B1 * | 5/2004 | Bahnen et al. | 417/417 |
| 6,737,766 | B1 * | 5/2004 | Burrola et al. | 310/23 |
| 6,923,628 | B1 | 8/2005 | Otto | |
| 6,939,392 | B2 * | 9/2005 | Huang et al. | 95/46 |
| 6,941,934 | B2 | 9/2005 | Weldon et al. | |
| 6,983,923 | B2 | 1/2006 | Fukui et al. | |
| 7,049,925 | B2 * | 5/2006 | Kawano et al. | 336/234 |
| 7,066,154 | B2 | 6/2006 | Zdravkovic et al. | |
| 7,071,584 | B2 * | 7/2006 | Kawano et al. | 310/14 |
| 7,093,437 | B2 | 8/2006 | Spadaccini et al. | |
| 7,231,768 | B2 | 6/2007 | Spadaccini et al. | |
| 2005/0135946 | A1 * | 6/2005 | Kang et al. | 417/416 |
| 2005/0163635 | A1 * | 7/2005 | Berwanger et al. | 417/415 |
| 2005/0201875 | A1 * | 9/2005 | Park | 417/417 |
| 2006/0087180 | A1 * | 4/2006 | Woo et al. | 310/12 |
| 2006/0254422 | A1 | 11/2006 | Spadaccini et al. | |

FOREIGN PATENT DOCUMENTS

| | | | |
|---|---|---|---|
| EP | 1798435 | A1 * | 6/2007 |
| WO | 2005008867 | | 1/2005 |

* cited by examiner

*Primary Examiner* — Charles Freay
*Assistant Examiner* — Philip Stimpert
(74) *Attorney, Agent, or Firm* — O'Shea Getz P.C.

(57) ABSTRACT

Vacuum pressure systems are provided. In this regard, a representative vacuum pressure system includes: an inlet; and a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core; the linear actuator being operative to exhibit relative motion between the permanent magnet and the coil responsive to an electrical current being applied to the coil such that the linear actuator forms vacuum pressure and draws fluid into the inlet.

19 Claims, 2 Drawing Sheets

VACUUM PRESSURE SYSTEMS

BACKGROUND

1. Technical Field

The disclosure generally relates to use of vacuum pressure.

2. Description of the Related Art

Vacuum pumps are pumps that remove gas to leave behind partial vacuums. As such, vacuum pumps are used as sources of vacuum for a variety of applications. By way of example, vacuum pumps oftentimes are incorporated into aircraft. In such an implementation, the vacuum pressure provided by a vacuum pump is oftentimes used to power gyroscopes of various flight instruments.

SUMMARY

Vacuum pressure systems are provided. In this regard, an exemplary embodiment of a vacuum pressure system comprises: an inlet; and a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core; the linear actuator being operative to exhibit relative motion between the permanent magnet and the coil responsive to an electrical current being applied to the coil such that the linear actuator forms vacuum pressure and draws fluid into the inlet.

Another exemplary embodiment of a system comprises: a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core; a gas outlet pneumatically communicating with the linear actuator; and a conduit having a gas permeable portion; the linear actuator being operative to exhibit relative motion between the permanent magnet and the coil responsive to an electrical current being applied to the coil such that the linear actuator forms vacuum pressure, draws gas from the conduit via the gas permeable portion, and expels the gas through the outlet.

Another exemplary embodiment of a system comprises: a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core; a gas outlet pneumatically communicating with the linear actuator; and a fuel conduit having a gas permeable portion; the linear actuator being operative to exhibit relative motion between the permanent magnet and the coil responsive to an electrical current being applied to the coil such that the linear actuator forms vacuum pressure, draws gas from the conduit via the gas permeable portion, and expels the gas through the outlet.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Vacuum pressure systems are provided, several exemplary embodiments of which will be described in detail. In this regard, such systems involving the use of a permanent magnet linear actuator for creating vacuum pressure. Notably, some embodiments are configured as moving magnet linear actuators that can reduce the need for flexible electrical connections to provide current to the coil of the linear actuator.

Figure 1:
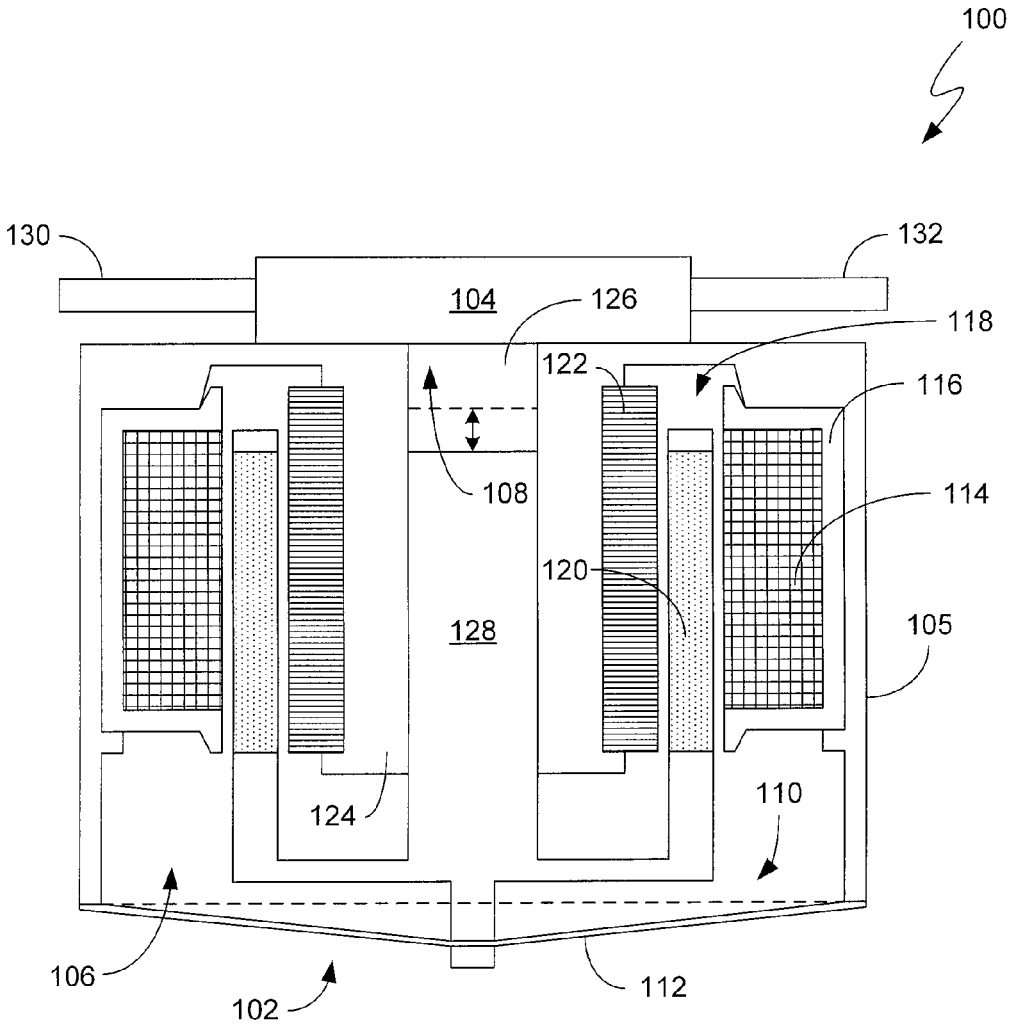
FIG. 1 is a schematic diagram of an exemplary embodiment of a vacuum pressure system.

FIG. 1 is a schematic diagram depicting an exemplary embodiment of a vacuum pressure system. As shown in FIG. 1, system 100 incorporates a permanent magnet linear actuator 102 and a valve assembly 104. The linear actuator includes a housing 105 that defines an interior chamber 106, in which moving and non-moving components of the linear actuator are located. In the embodiment of FIG. 1, the housing includes openings 108, 110, with valve assembly 104 forming an airtight seal with opening 108, and a biasing member 112 forming an airtight seal with opening 110.

With respect to the non-moving components of the linear actuator, these components include stator windings 114 and an outer ferromagnetic core 116 located annularly about an outer periphery of the stator windings. Radially inboard of the stator windings is a first annular cavity 118 within which a moving magnet 120 reciprocates.

An inner radius of the cavity 118 is defined by an inner ferromagnetic core 122. The inner ferromagnetic core is mounted to the exterior of a cylinder 124, the interior chamber 126 of which receives a piston 128. The piston is attached to and moves with the moving magnet 120, thereby forming a moving magnet assembly that is attached to biasing member 112. Note that in the embodiment of FIG. 1, the biasing member is a diaphragm that forms an airtight seal with the housing to prevent fluids drawn into the housing via movement of the piston from departing the housing at a location other than opening 108.

In this regard, opening 108 is capped by valve assembly 104, which is controlled to selectively position a valve (not shown). Positioning of the valve permits fluid to be alternately drawn into and expelled from the interior chamber 126 of the cylinder responsive to movement of the piston 128.

In operation, electrical current applied to the stator windings 114 causes the moving magnet 120 to be displaced linearly against the biasing force of the biasing member 112. As such, the moving magnet assembly (i.e., the magnet and piston) moves away from opening 108. Movement of the moving magnet assembly in this direction creates a partial vacuum within the interior chamber 126, which draws fluid into the chamber. Specifically, fluid enters the valve assembly via an inlet 130, and then is drawn through the valve assembly into chamber 126. The current applied to the stator windings then can be controlled such that the biasing member overcomes the displacement force, thereby returning piston 128 toward the neutral position (indicated by the dashed lines). Movement of the piston in this direction, in concert with repositioning of one or more valves of the valve assembly, causes at least some of the fluid drawn into chamber 126 to be expelled from the system via outlet 132. The valve assembly can be repositioned for example to restrict the fluid from being expelled through the inlet 130. Depending upon the particular application, the fluid acted upon by such a system can be liquid and/or gas.

Figure 2:
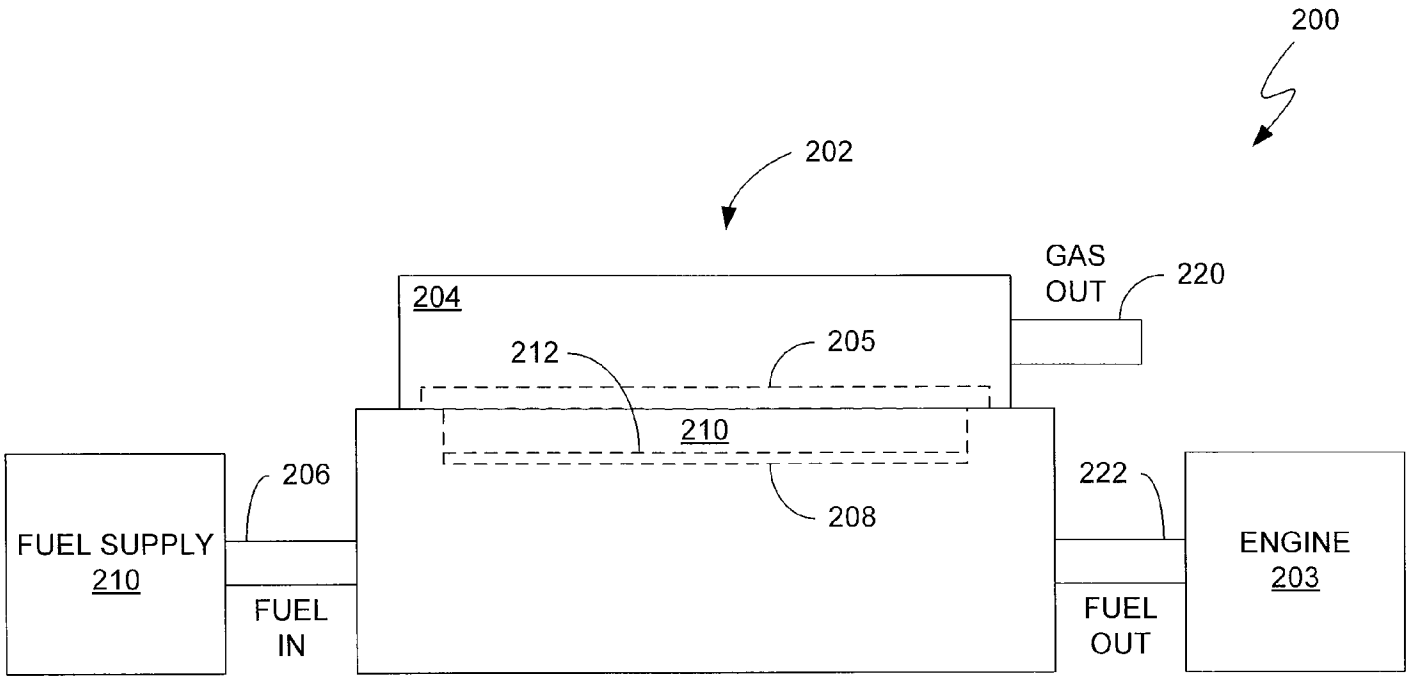
FIG. 2 is a schematic diagram of another exemplary embodiment of a vacuum pressure system.

In this regard, reference is made to the schematic diagram of FIG. 2, which depicts an exemplary embodiment of a system 200 that incorporates a fuel supply 201, a gas extraction unit 202 and an engine 203 (e.g., a gas turbine engine). Gas extraction unit 202 includes a permanent magnet linear actuator 204, a valve assembly 205 and a fuel conduit 206. The fuel conduit includes a gas permeable portion 208 which, in some embodiments, is configured as a gas permeable membrane. The gas permeable portion communicates with a gas manifold 210 which, in turn, communicates with valve assembly 205.

In operation, fuel (e.g., aviation fuel) in the conduit passes the gas permeable portion during which the non-liquid side 212 of the gas permeable portion is exposed to partial vacuum pressure provided by the linear actuator. Exposure to the partial vacuum pressure causes at least some of the gas carried by the liquid to be drawn through the gas permeable portion and into the gas manifold. By way of example, when the liquid is aviation fuel, dissolved oxygen can be drawn from the fuel. More detailed information regarding extraction of gas from fuel can be found in U.S. Published Patent Application 2006/0254422, which is incorporated by reference herein.

From the gas manifold, operation is similar to that described before with respect to the embodiment of FIG. 1. That is, the gas manifold functions as an inlet to the valve assembly, supplying gas to the linear actuator. From the linear actuator, the gas can be expelled from an outlet 220 responsive to interaction between the valve assembly and motion of an associated piston (not shown) of the linear actuator. The fuel can then be provided to engine 203 via fuel outlet 222.

In the embodiment of FIG. 2, the fuel carried by the conduit is used to cool the linear actuator. Specifically, cooling is provided by heat transfer from the linear actuator, to the conduit and then to the fuel carried by the conduit. In other embodiments, such as those in which the fluid being pumped by the linear actuator is a liquid, the linear actuator may be at least partially immersed in the liquid to enhance cooling. Thus, direct heat transfer from the linear actuator to the liquid can be provided in some embodiments.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, although the liquid from which gas is extracted in the embodiment of FIG. 2 is fuel, various other liquids could be used. All such modifications and variations are intended to be included herein within the scope of this disclosure and protected by the accompanying claims.

The invention claimed is:

1. A vacuum pressure system comprising:

an inlet;

a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core;

the linear actuator being operative to exhibit relative motion between the peimanent magnet and the coil responsive to an electrical current being applied to the coil such that the linear actuator forms vacuum pressure and draws fluid into the inlet; and a biasing member operative to bias the permanent magnet against a force caused by the electrical current being applied to the coil, which biasing member comprises a diaphragm that forms a seal with a housing, which housing includes a sidewall and an endwall, and which sidewall extends from the diaphragm to the endwall thereby sealingly defining an interior chamber within the housing in which the linear actuator is located;

wherein the endwall includes an aperture that fluidly communicates with the inlet.

2. The system of claim 1, wherein:

the system further comprises an outlet; and the linear actuator is further operative to expel at least some of the fluid drawn into the inlet through the outlet.

3. The system of claim 1, wherein:

the system further comprises a valve assembly; and the valve assembly is operative to restrict a backflow of the fluid through the inlet.

4. The system of claim 1, wherein:

the permanent magnet is operative to move relative to the coil, the inner ferromagnetic core and the outer ferromagnetic core; and the coil, the inner ferromagnetic core and the outer ferromagnetic core are fixed in position relative to each other.

5. The system of claim 4, wherein:

the system further comprises a piston; and the piston is operative to reciprocate linearly with the permanent magnet.

6. The system of claim 4, wherein the fluid is a gas.

7. The system of claim 1, wherein the permanent magnet is disposed between the inner ferromagnetic core and the outer ferromagnetic core.

8. A vacuum pressure system comprising:

a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core;

a gas outlet pneumatically communicating with the linear actuator;

a conduit having a gas permeable portion;

the linear actuator being operative to exhibit relative motion between the permanent magnet and the coil responsive to an electrical current being applied to the coil such that the linear actuator forms vacuum pressure, draws gas from the conduit via the gas permeable portion, and expels the gas through the gas outlet; and a biasing member operative to bias the permanent magnet against a force caused by the electrical current being applied to the coil, which biasing member comprises a diaphragm that forms a seal with a housing, which housing includes a sidewall and an endwall, and which sidewall extends from the diaphragm to the endwall thereby sealingly defining an interior chamber within the housing in which the linear actuator is located;

wherein the endwall includes an aperture that fluidly communicates with the gas outlet.

9. The system of claim 8, wherein:

the conduit is operative to deliver fuel; and the gas permeable portion is permeable with respect to oxygen such that, in operation, the linear actuator draws oxygen from the fuel in the conduit.

10. The system of claim 9, wherein, in operation, at least a portion of the linear actuator is cooled by the fuel.

11. The system of claim 8, wherein the gas permeable portion is a gas permeable membrane.

12. The system of claim 8, wherein:

the permanent magnet is operative to move relative to the coil, the inner ferromagnetic core and the outer ferromagnetic core; and the coil, the inner ferromagnetic core and the outer ferromagnetic core are fixed in position relative to each other.

13. The system of claim 8, wherein the permanent magnet is disposed between the inner ferromagnetic core and the outer ferromagnetic core.

14. A system comprising:

a linear actuator having a permanent magnet, a coil, an inner ferromagnetic core and an outer ferromagnetic core, the outer ferromagnetic core surrounding at least a portion of each of the permanent magnet, the coil, and the inner ferromagnetic core;

a gas outlet pneumatically communicating with the linear actuator;

a fuel conduit having a gas peimeable portion;

the linear actuator being operative to exhibit relative motion between the permanent magnet and the coil responsive to an electrical current being applied to the coil such that the linear actuator forms vacuum pressure, draws gas from the fuel conduit via the gas permeable portion, and expels the gas through the gas outlet; and a biasing member operative to bias the permanent magnet against a force caused by the electrical current being applied to the coil, which biasing member comprises a diaphragm that forms a seal with a housing, which housing includes a sidewall and an endwall, and which sidewall extends from the diaphragm to the endwall thereby sealingly defining an interior chamber within the housing in which the linear actuator is located;

wherein the endwall includes an aperture that fluidly communicates with the gas outlet.

15. The system of claim 14, wherein, in operation, at least a portion of the linear actuator is cooled by the fuel.

16. The system of claim 14, wherein the gas permeable portion is a gas permeable membrane.

17. The system of claim 14, further comprising an engine operative to receive fuel from which gas has been extracted using the linear actuator.

18. The system of claim 17, wherein the engine is a gas turbine engine.

19. The system of claim 14, wherein the permanent magnet is disposed between the inner ferromagnetic core and the outer ferromagnetic core.

* * * * *